US005888652A

United States Patent [19]

Berbner et al.

[11] Patent Number: 5,888,652

[45] Date of Patent: Mar. 30, 1999

[54] METAL COATED MELAMINE RESIN FIBER AND NATURAL FIBER MIXTURE

[75] Inventors: Heinz Berbner, Mörlenbach; Hans-Dieter Eichhorn, Weisenheim am Berg; Karl Ott, Plankstadt, all of Germany

[73] Assignee: BASF Aktiengesellschaft, Ludwigshafen, Germany

[21] Appl. No.: 981,544

[22] PCT Filed: Jun. 20, 1996

[86] PCT No.: PCT/EP96/02678

§ 371 Date: Dec. 11, 1997

§ 102(e) Date: Dec. 11, 1997

[87] PCT Pub. No.: WO97/01661

PCT Pub. Date: Jan. 16, 1997

[30] Foreign Application Priority Data

Jun. 26, 1995 [DE] Germany ..... 195 23 081.7

[51] Int. Cl.[6] ..... B32B 9/00

[52] U.S. Cl. ..... 428/389; 428/378; 19/145.5; 442/377; 139/425 R

[58] Field of Search ..... 19/145.5; 442/377; 428/378, 389; 139/425 R

[56] References Cited

U.S. PATENT DOCUMENTS

| | | |
|---|---|---|
| B 519,355 | 4/1976 | Baird et al. . |
| 4,088,621 | 5/1978 | Nihongi et al. . |
| 4,257,221 | 3/1981 | Feinberg . |
| 5,496,625 | 3/1996 | Lilani . |
| 5,560,961 | 10/1996 | Adel et al. . |
| 5,560,990 | 10/1996 | Ilg et al. . |

FOREIGN PATENT DOCUMENTS

| | | |
|---|---|---|
| 528 192 | 2/1993 | European Pat. Off. . |
| 23 64 091 | 7/1974 | Germany . |
| 95/14126 | 5/1995 | WIPO . |

*Primary Examiner*—Christopher Raimund
*Attorney, Agent, or Firm*—Keil & Weinkauf

[57] ABSTRACT

A fiber blend of (a) from 10 to 90 parts by weight of metal-coated melamine resin fibers or a blend of uncoated and metal-coated resin fibers and (b) from 90 to 10 parts by weight of natural fibers and wovens, nonwovens, yarns, tapes or moldings formed from the blend.

7 Claims, No Drawings

METAL COATED MELAMINE RESIN FIBER AND NATURAL FIBER MIXTURE

The present invention relates to a fiber blend comprising (a) from 10 to 90 parts by weight of melamine resin fibers and (b) from 90 to 10 parts by weight of natural fibers.

Fibers composed of melamine-formaldehyde condensation products are known, for example from DE-B-23 64 091. They are incombustible, flame resistant and heat resistant. Owing to these properties, they are used for manufacturing fire resistant textiles. However, there are applications for which the fibers are not sufficiently strong and there are applications where their low abrasion resistance is a disadvantage.

The disadvantage of natural fibers is that they require the addition of flame retardants to render them nonflammable. However, flameproofed natural fibers such as cotton lose some of the flame retardant in the course of washing, and the result is an increased risk of fire, for example in the case of welders, suits.

It is an object of the present invention to improve the properties of melamine resin fibers on the one hand and the properties of natural fibers on the other.

We have found that this object is achieved by the above-defined fiber blend. This invention further provides fiber blends additionally including other fibers and/or metal fibers or conductive polymer fibers and also a process for their production and the use of the fiber blends of this invention for producing wovens, nonwovens, yarns, tapes and moldings and the use of melamine resin fibers for producing the fiber blends of this invention.

According to DE-B-23 64 091, the melamine resin solution used for spinning the melamine resin fibers may have added to it, during spinning, solutions of other fiber-forming polymers, including solutions of polyamides in organic solvents. Preference is given to adding to the melamine resin solution aqueous solutions of polyvinyl alcohol as a way of improving the mechanical properties of the fibers produced by the spinning process. This reference thus involves spinning mixtures or solutions of different polymers to produce multicomponent fibers (blends of polymers within a single fiber), whereas the present invention involves blending various ready-produced single-component fibers to produce fiber blends (blends of different fibers).

A. Melamine resin fibers are notable for their high temperature resistance and incombustibility. Their production and properties are known, for example from DE-A-23 64 091. They are preferably produced from highly concentrated solutions of melamine-formaldehyde precondensation products after addition of an acidic curing agent, by centrifugal spinning, drawing out, extrusion or fibrillation. The fibers obtained are generally predried and optionally stretched, and the melamine resin is customarily cured at from 120° to 250° C. The fibers are typically from 5 to 25 $\mu$m in thickness and from 2 to 2,000 mm in length. Particularly thermally stable fibers are obtained when up to 30 mol %, in particular from 2 to 20 mol %, of the melamine in the melamine resin is replaced by a hydroxyalkylmelamine, as described in EP-A 221 330 or EP-A 523 485. Such fibers have a sustained use temperature of up to 200° C., preferably up to 220 ° C. In addition, minor amounts of melamine can be replaced by substituted melamines, urea or phenol. Particular preference is given to condensation products obtainable by condensation of a mixture including as essential components (A) from 90 to 99.9 mol % of a mixture consisting essentially of (a) from 30 to 99 mol % of melamine and (b) from 1 to 70 mol % of a substituted melamine of the general formula I

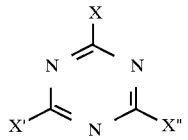

I where X, X' and X" are each selected from the group consisting of —$NH_2$, —NHR and —NRR', and X, X' and X" are not all —$NH_2$, and R and R' are each selected from the group consisting of hydroxy-$C_2$–$C_{10}$-alkyl, hydroxy-$C_2$–$C_4$-alkyl-(oxa-$C_2$–$C_4$-alkyl)$_n$, where n is from 1 to 5, and amino-$C_2$–$C_{12}$-alkyl, or mixtures of melamines I, and (B) from 0.1 to 10 mol %, based on (A) and (B), of phenols which are unsubstituted or substituted by radicals selected from the group consisting of $C_1$–$C_9$-alkyl and hydroxyl, $C_1$–$C_4$-alkanes substituted by two or three phenol groups, di(hydroxyphenyl) sulfones, or mixtures thereof, with formaldehyde or formaldehyde-supplying compounds in a molar ratio of melamines to formaldehyde within the range from 1:1.15 to 1:4.5.

The following compounds are substituted melamines particularly suitable for this invention:

2-hydroxyethylamino-substituted melamines such as 2-(2-hydroxyethylamino)-4,6-diamino-1,3,5-triazine, 2,4-di(2-hydroxyethylamino)-6-amino-1,3,5-triazine, 2,4,6-tris(2-hydroxyethylamino)-1,3,5-triazine, 2-hydroxyisopropylamino-substituted melamines such as 2-(2-hydroxyisopropylamino)-4,6-diamino-1,3,5-triazine, 2,4-di(2-hydroxyisopropylamino)-6-amino-1,3,5-triazine, 2,4,6-tris(2-hydroxyisopropylamino)-1,3,5-triazine, 5-hydroxy-3-oxapentylamino-substituted melamines such as 2-(5-hydroxy-3-oxapentylamino)-4,6-diamino-1,3,5-triazine, 2,4-di(5-hydroxy-3-oxapentylamino)-6-amino-1,3,5-triazine, 2,4,6-tris(5-hydroxy-3-oxapentylamino)-1,3,5-triazine, 6-aminohexylamino-substituted melamines such as 2-(6-aminohexylamino)-4,6-diamino-1,3,5-triazine, 2,4-di(6-aminohexylamino)-6-amino-1,3,5-triazine, 2,4,6-tris(6-aminohexylamino)-1,3,5-triazine or mixtures thereof, for example a mixture of 10 mol % of 2-(5-hydroxy-3-oxapentylamino)-4,6-diamino-1,3,5-triazine, 50 mol % of 2,4-di(5-hydroxy-3-oxapentylamino)-6-amino-1,3,5-triazine and 40 mol % of 2,4,6-tris(5-hydroxy-3-oxapentylamino)-1,3,5-triazine.

Suitable preferred phenols are phenol, 4-methylphenol, 4-tert-butylphenol, 4-n-octylphenol, 4-n-nonylphenol, pyrocatechol, resorcinol, hydroquinone, 2,2-bis(4-hydroxyphenyl)propane, 4,4'-dihydroxydiphenyl sulfone, particularly preferably phenol, resorcinol and 2,2-bis(4-hydroxyphenyl)propane.

Formaldehyde is generally used as an aqueous solution having a concentration of, for example, from 40 to 50% by weight or in the form of compounds supplying formaldehyde in the course of the reaction with (A) and (B), for example as oligomeric or polymeric formaldehyde in solid form such as paraformaldehyde, 1,3,5-trioxane or 1,3,5,7-tetroxocane.

Fibers are produced using advantageously from 1 to 50, preferably from 5 to 15, in particular from 7 to 12, mol % of the substituted melamine and also from 0.1 to 9.5, preferably from 1 to 5, mol % of one or the above-recited phenols or mixtures thereof.

B. The natural fibers used are generally naturally occurring fibers based on cellulose, such as cotton, wool, linen or silk, which natural fibers shall also comprehend cellulose-based fibers which are of natural origin but have been modified or treated by known and customary processes.

According to German Standard Specification DIN 60001, cotton and wool in particular are natural fibers, cotton belonging to the group of vegetable fibers. German Standard Specification DIN 60004 defines what is meant by the term wool. For the purposes of this invention, wool shall comprehend all coarse and fine animal hairs.

Furthermore, melamine resin fibers may contain the customary additives such as fillers, dyes, pigments, metal powders and delusterants or may already be dyed. Similarly, the natural fibers can have been dyed and lubricated for spinning before processing.

The two fiber varieties are generally intermixed on conventional fiber-blending apparatus as described in Vliesstoffe, Georg Thieme Verlag. The starting materials are staple fibers typically from 1 to 20 cm in length. These are generally fed via a conveying means into a flat-top card and premixed therein. The intermixing is then completed in a roller card. The wadding obtained is then further processed into yarns or nonwovens, for which the processes customary in the textile industry can be used.

Depending on the field of application, these yarns, nonwovens or wovens can then be further processed into various textile or nontextile structures such as, for example, gloves, fire protection suits and also extinguishing and fire-safety blankets.

These blend yarns or nonwovens/articles from these blends are notable for excellent wear comfort. However, the outstanding feature is that the yarns, wovens or nonwovens with melamine resin fiber contents of at least 50–60% by weight do not burn, even though the natural fibers can be used without any flameproofing finish whatsoever.

A preferred embodiment concerns a fiber blend comprising (a) from 10 to 90, preferably from 30 to 70, parts by weight of melamine resin fibers, (b) from 90 to 10, preferably from 70 to 30, parts by weight of natural fibers and (c) from 2 to 25, preferably from 5 to 15, parts by weight, based on (a) and (b), of other fibers.

Suitable other fibers include fibers of nonflammable or low-flammability materials such as m- and p-aramids, glass, polyimides, polybenzimidazoles, carbon, preoxidized polyacrylonitrile and also fibers composed of thermoplastic polymers such as high strength polyethylene, polypropylene, polyesters, polyamides, polyvinyl chloride or polyvinyl alcohols.

From observations to date, the addition of other fibers makes it possible to produce nonwovens and wovens with a higher strength than nonwovens and wovens without the other fibers without adversely affecting the fire behavior.

A further preferred embodiment concerns fiber blends comprising (a) from 10 to 90, preferably from 30 to 70, parts by weight of melamine resin fibers (b) from 90 to 10, preferably from 70 to 30, parts by weight of natural fibers, (c) optionally from 2 to 25, preferably from 5 to 15, parts by weight, based on (a) and (b), of other fibers as described above, and (d) from 0.1 to 5, preferably from 0.5 to 2, parts by weight, based on the sum of (a)+(b)+(c), of metal fibers or conductive polymer fibers.

Suitable metal fibers include for example those based on stainless steel.

Suitable conductive polymer fibers include those having a core of polyamide, polyester and a conductive coating and also metal-coated melamine resin fibers as described in EP-A 528 192, preferably those with a core of polyester.

A further preferred embodiment comprises using metal-coated melamine resin fibers, preferably aluminum-coated melamine resin fibers, by which are also meant blends of uncoated and metal-coated melamine resin fibers. More particularly, the aluminum-coated melamine resin fibers can be produced in a conventional manner, for example by adhering aluminum foil or an aluminized film to the melamine resin fibers or by subjecting the melamine resin fibers to a high vacuum aluminum vapor deposition process. The thickness of the metal layer, especially of the aluminum layer, is customarily selected within the range from 10 to 150 $\mu$m, preferably within the range from 50 to 100 $\mu$m.

The metallation is generally effected by subjecting the woven to a high vacuum metal vapor deposition process (see Ullmann's Enzyklopadie der Technischen Chemie, 3rd Edition, Vol. 15, p. 276 and references cited therein). It is also possible to adhere thin metal foils to the woven. Such metal foils generally comprise a polymeric support film which has been coated with a thin film of metal. They preferably comprise a polymeric support based on polyester. The metallized films are suitable according to German Armed Forces Supply Specification TL 8415-0203 for application to the woven of the invention on one or preferably both sides thereof, for example by means of an adhesive or by hot calendering. Such foils are used by various manufacturers for the coating of wovens (e.g., Gentex Corp., Carbondale Pa., USA; C.F. Ploucquet GmbH & Co, D-89522 Heidenheim; Darmstädter GmbH, D-46485 Wesel).

It is further possible to produce the wovens of the invention from metallized yarns. Such yarns are preferably coated with aluminum in layer thicknesses within the range of 10–100 $\mu$m. Such yarns are producible for example on the lines of the processes described in DE-B 27 43 768, DE-A 38 10 597 or EP-A 528 182.

Blends of 50% by weight of Basofil and 50% by weight of nonflameproofed cotton meet according to pr EN 532 the requirements of Index 2 of limited flame spread defined in pr EN 533. A blend of 60% by weight of Basofil and 40% by weight of nonflameproofed cotton achieves a fire class rating of $S_b$ under German Standard Specifications DIN 54336 and DIN 66083.

Wovens composed of the blends of this invention are very useful for protective suits for welding and steelmaking, in particular for protecting against convective heat, radiant heat and splashes of liquid metal.

Wovens or nonwovens of this invention produced from the fiber blends of this invention that include thermoplastic fibers can be processed by conventional methods into shaped articles such as protective hoods for heat insulation, in which case the thermoplastic fibers generally act as binding or bonding fibers.

Furthermore, the fiber blends of this invention can be used for producing yarns and tapes in a conventional manner.

EXAMPLES

Example 1

50 tex/2 yarns were ring-spun from a blend composed of 60% by weight of melamine resin fibers (BASOFIL® from BASF; produced similarly to the example of EP-A 624 665) and 40% by weight of nonflameproofed cotton (from Russia, having an average length of 32 mm). The yarn thus produced was woven up into a 2/2 twill having a basis weight of 310 g/m$^2$. The woven thus produced was tested in accordance with DIN 54336, and the parameters for the fire behavior of textile products were determined in accordance with DIN 66083. The fabric produced according to the invention achieved fire class $s_b$.

For comparison: A similarly produced fabric woven from cotton is completely consumed under the test conditions, so that classification in a fire class is not possible.

Example 2

A blend composed of 50 parts of melamine resin fibers (as in Example 1) and 50 parts of nonflameproofed cotton (as in Example 1) was used to produce a needlefelt web having a basis weight of 400 g/m$^2$ by needling with a machine from Pilo. The nonwoven thus produced was investigated in respect of its fire behavior as described in Example 1. Result: the nonwoven achieved fire class $S_b$.

The web was found to have an ultimate tensile strength of 520N in a strip tensile test on the lines of DIN 53857.

Example 3

A blend composed of 45 parts of melamine resin fibers (as in Example 1) and 45 parts of nonflameproofed cotton (as in Example 1) and also 10 parts of polypropylene fibers (15 mm in length, 15 $\mu$m in diameter) was used to produce a needlefelt having a basis weight of 400 g/m$^2$ by needling with a machine from Pilo. The web thus produced was calendered at 200° C. The calendered web was then investigated in respect of its fire behavior similarly to the method of Example 1. Result: the web achieved fire class $S_b$. The calendered web was found to have an ultimate tensile strength of 740N in the strip tensile test of DIN 53857.

Example 4

Example 3 was repeated with the blend of Example 2. The ultimate tensile strength of the calendered web was 620N.

Example 5

A blend consisting of 60% by weight of Basofil® (as in Example 1) and 40% by weight of nonflameproofed cotton (as in Example 1) was rotor-spun to produce a yarn having a linear density of 50 tex. A 2-fold thread was then produced on a customary folding machine. This thread was knitted up on a customary finger knitting glove machine to produce finger gloves. The weight per glove was 54 g. The basis weight was 800 g/m$^2$. A threshold time of 14.6 sec was determined at a contact temperature of 250° C. in accordance with European Standard EN 702.

A para-aramid glove of the same weight was tested for comparison. At the same contact temperature, the threshold time was found to be only 8.9 sec.

Example 6

Nm32/2 yarns were ring-spun from a blend composed of 64% by weight of melamine resin fiber (Basofil® from BASF), 35% by weight of commercially available New Zealand wool and also 1% by weight of steel fiber (diameter 6 $\mu$m, 36 mm in length). This yarn was then woven up to produce a plain weave having a basis weight of 275 g/m$^2$.

Selected tests in accordance with DIN EN 531:1995, protective clothing for heat-exposed industrial workers 1. Limited flame spread as defined in DIN EN 532:1995

Continued burning to the upper and side edges no

Holing no

Burning or melting drips no

Afterburn time 0 seconds

Afterglow time 0 seconds

The woven consequently far exceeded the requirements of DIN EN 531 (code letter A). This standard in fact allows 2 seconds each for the afterburn time and the afterglow time.

2. Convective heat as defined in DIN EN 367:1992

HTI value 6 seconds

The woven achieved performance level B1 of DIN EN 531:1995

3. Radiant heat as defined in DIN EN 366:1993

$t_2$ value 20 seconds

The woven achieved performance level C1 of DIN EN 531:1995

4. Liquid iron splashes as defined in DIN EN 373:1993

Mass of iron causing no damage to PVC film 62 g

The woven achieved performance level E1 of DIN EN 531:1995

Tests in accordance with DIN EN 470-1: 1995, protective clothing for welding and related processes

| | Test value | Required by standard |
|---|---|---|
| 1. ISO 5081 tensile strength | Warp 550N<br>Weft 490N | >300N<br>>300N |
| 2. ISO 4674 tear strength | Warp 54N<br>Weft 48N | >15N<br>>15N |
| 3. ISO 6330/5077 dimensional change | Warp −2.5%<br>Weft −0.7% | <+3%<br><+3% |
| 4. Response to small metal splashes as defined in DIN EN 348:1992 Number of drops of metal which cause a 40K temperature increase on the reverse side of the specimen | 33 | >15 |

We claim:

1. A fiber blend comprising (a) from 10 to 90 parts by weight of metal-coated melamine resin fibers or a blend of uncoated and metal-coated melamine resin fibers and (b) from 90 to 10 parts by weight of natural fibers.

2. The fiber blend as defined in claim 1, further comprising (c) from 2 to 25 parts by weight, based on the sum of (a) and (b), of other fibers.

3. The fiber blend as defined in claim 2, further comprising (d) from 0.1 to 5 parts by weight, based on the sum of (a), (b) and (c), of metal fibers or conductive polymer fibers.

4. Gloves, fire protection suits, extinguishing and fire-safety blankets formed from the fiber blend of claim 1.

5. Welder's protective clothing and clothing for protection against convective heat, radiant heat and splashes of liquid metal formed from the fiber blend of claim 1.

6. A process for producing a fiber blend as defined in claim 1, which comprises blending (a) from 10 to 90 parts by weight of metal-coated melamine resin fibers or a blend of uncoated and metal-coated melamine fibers; and (b) from 90 to 10 parts by weight of natural fibers.

7. A process for producing a fiber blend as defined in claim 2, which comprises blending (a) from 10 to 90 parts by weight of metal coated melamine resin fibers or a blend of uncoated and metal-coated melamine fibers;

(b) from 90 to 10 parts by weight of natural fibers; and (c) from 2 to 25 parts by weight, based on the sum of (a) and (b), of other fibers.

* * * * *